United States Patent [19]

Johnston

[11] 4,027,876

[45] June 7, 1977

[54] EXERCISING APPARATUS

[76] Inventor: Lyman Clarke Johnston, 12 Boulton Drive, Toronto, Ontario, Canada

[22] Filed: Apr. 7, 1976

[21] Appl. No.: 674,580

[52] U.S. Cl. ..... 272/133; 182/190; 188/65.5; 242/154

[51] Int. Cl.[2] ..... A63B 21/00

[58] Field of Search ..... 272/133; 188/65.4, 65.5; 242/154; 182/190–193

[56] References Cited

UNITED STATES PATENTS

| | | | |
|---|---|---|---|
| 119,997 | 8/1871 | Rice | 188/65.5 |
| 287,856 | 11/1883 | Parsels | 188/65.5 |
| 376,787 | 1/1888 | Smith et al. | 188/65.5 X |
| 3,197,204 | 7/1965 | Holkesvick et al. | 272/133 |
| 3,462,142 | 8/1969 | Sterndale | 272/133 |
| 3,506,262 | 4/1970 | Wade | 272/133 |
| 3,591,174 | 7/1971 | Silberman et al. | 272/133 |
| 3,782,722 | 1/1974 | Webb | 272/133 |
| 3,885,789 | 5/1975 | Deluty et al. | 272/133 |

*Primary Examiner*—Paul E. Shapiro
*Attorney, Agent, or Firm*—William T. Howell

[57] ABSTRACT

A portable exercising apparatus for a supine user has an open ended inwardly tapered member with a block member inside, the position of which is adjustable. The block member has a channel which provides a passage for a pair of ropes frictionably engageable between the tapered and block members which frictional engagement is variable because the position of the block member is adjustable. The ends of the ropes emerging from one end of the channel, out of the tapered member, each have a hand grip, while the other ends of the pairs of ropes are joined to form a pair of loops slidably engaged in a tube which provides for adjustment of the length of the loops. A pair of bands are slidably secured to both loops by a sleeve, these bands providing containment for the feet of the user. Preferably the tapered member is made of a material having a high heat conductivity and the block member of a material having low heat conductivity this minimises the temperature rise due to friction. A temperature indicator is included in the block member to monitor the effort expended by the user in overcoming the frictional resistance.

10 Claims, 3 Drawing Figures

16
17
12
10
2
37
24a
24b
26
28
32
34

14
18
20
22
27a
27b
27c
27d
30a
30b

36

EXERCISING APPARATUS

FIELD OF INVENTION

This invention relates to exercising apparatus wherein the user thereof, while supine, moves both arms and legs, the one exerting a force on the other through the medium of the apparatus.

PRIOR ART

Many forms of exercising apparatus utilise adjustable weights or springs to provide the requisite resistance to movement of the limbs of the user but care is necessary to avoid undue strain in their use.

SUMMARY OF THE INVENTION

It is an object of the invention to provide an exercising apparatus of the frictional type which eliminates the use of weights, at the same time acheiving the desirability of adjusting frictional resistance to effort to suit the capabilities of the user whilst supine.

It is a further object of the invention to provide exercising apparatus of the frictional type which dissipates the heat evolved in the part of the apparatus providing the frictional resistance to an extent which will minimise deterioration of the ropes engaging this part.

The portable exercising apparatus of the invention has an open ended inwardly tapered member, shaped somewhat like a bell. Positioned inside is a block member having a channel which provides a passage for a pair of ropes frictionally engageable between the tapered member and the block member. The position of the block member inside the tapered member is adjustable to change the frictional resistance on the ropes and this is achieved by securing thereto a threaded member which extends outward of the tapered member through its base. A locking nut on the threaded member bears against the exterior of the tapered member and rotation of the threaded member thereby adjusts the position of the block member. The outward end of the threaded member is adapted for detachable securement to a fixed object and a preferred manner is to provide a loop of rope which is secured to a ring on the outward end of the threaded member.

The ends of the pair of ropes emerging from one end of the channel in the block member, and then through the open end of the tapered member, each have an individual hand grip. The emerging ends of the pair of ropes, each terminate in individual means for containing a foot of the user of the apparatus with an intermediate cross over rope arrangement to adjust the length.

The frictional effect on the ropes due to movement may be increased to a point where the heat evolved, unless dissipated, may lead to a localised temperature rise which will adversely effect the strength of the ropes. To promote disipation of the heat, and prevent this happening, the tapered member is preferably made of a material having a high heat conductivity, such as steel, while the block is preferably made of a durable material selected for its low heat conductivity, such as hard wood, glass or ceramic.

A temperature indicating device may be included to indicate to the user the extent of effort expended. This may be inserted in the end of the block member facing outward of the open end of the tapered member or a thermometer mounted on the outer tube. A particularly practical arrangement involves the use of a visual capsule containing heat sensitive salt.

DESCRIPTION OF A PREFERRED EMBODIMENT

Figures 1, 2, 3:
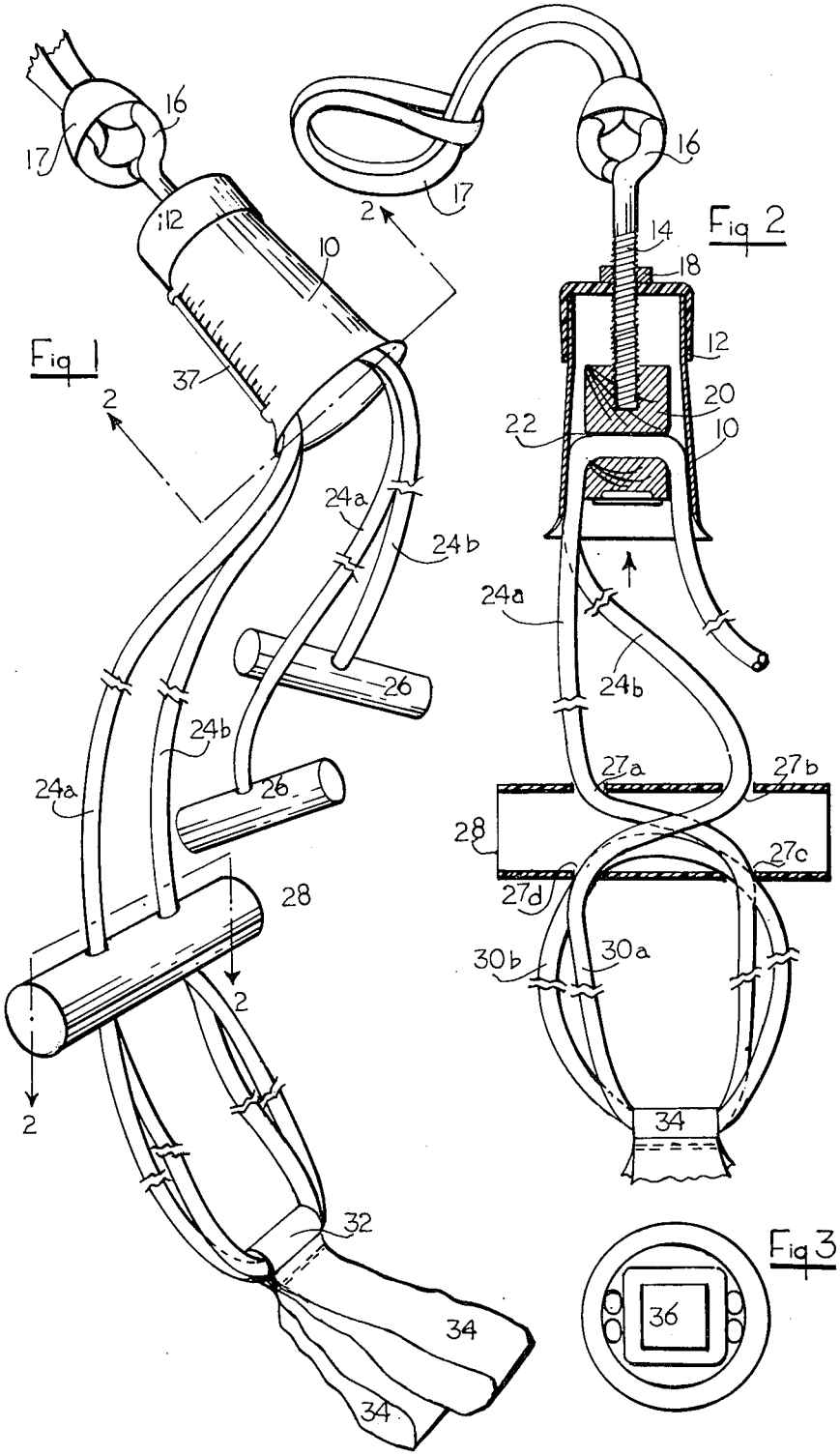
FIG. 1. is a perspective view of one embodiment of an exercising apparatus constructed according to the invention.
FIG. 2. is a cross section through the apparatus illustrated in FIG. 1.
FIG. 3. is a plan view in the direction of the arrow in FIG. 2.

In the drawings like members represent like parts.

The exercising apparatus illustrated has an open ended member 10 which in FIGS. 1 and 2 is shown to be tapered inwardly, thus exhibiting a bell like shape. A cap 12 surmounts the base of the tapered member 10. The threaded shank 14 of an outwardly positioned hook or ring 16 passes through the cap 12. The ring 16 provides a means for attaching the apparatus to a suitable fixed object and this preferably attached by means of a loop of rope 17. A locking nut 18, located on the threaded shank 14, bears against the exterior of the cap 12.

The inner end of the threaded shank 14 is secured to a block member 20 located in the tapered member 10. The block member 20 has a section as illustrated in FIGS. 2 and 3 but this is only a preferred configuration and it could be oval or circular provided that it is spaced from the tapered member. It will be appreciated that manual rotation of the ring 16 will cause the distance between the surface of the block member 20 and the inner surface of the tapered member 10 to decrease or increase, depending on the direction of rotation.

The inner block member 20 has a channel 22 which is large enough to provide passage for a pair of ropes **24*a* and 24*b* which are frictionally engageable with the inner surface of the tapered member 10 and the surface of the block member 20, the extent of the friction being adjustable by rotating the hook 16** already described.

The pair of ropes **24*a* and 24*b* emerging from one side of the channel 22 and then from the open end of the tapered member 10 have their ends secured to an individual tubular hand grip 26** simply achieved by knotting the rope end internally therein.

The pair of ropes **24*a* and 24*b* emerging from the other end of channel 22, and then from the open end of the tapered member 10, slidably enter respectively apertures 27*a* and 27*b* in a tube 28. The ropes 24*a* and 24*b* then cross over in the tube 28 and slidably leave respectively apertures 27*c* and 27*d* as illustrated in FIG. 2. The ropes 24*a* and 24*b* are then joined together to form a loop 30*a* but prior to them providing this formation, they also form another loop 30*b* as shown in FIG. 2 which is maintained in configuration as a loop by passage into the tube 28 through apertures 27*d* and 27*c*. It will be appreciated that the ropes 24*a* and 24*b* are formed in practice from a single length of rope and the loops 30*a* and 30*b*** are formed first of all in assembly.

The length of the loops **30*a* and 30*b* can be adjusted to make them uniform and also shorter or longer, by sliding the tube 28 along the pair of ropes 24*a* and 24*b*.**

The loops **30*a* and 30*b* are held together below the tube 28 by a sleeve 32 while carries a pair of individual bands 34** in which the feet of the user are located.

The frictional effect on the ropes due to movement may be increased to a point where the heat evolved, unless dissipated, may lead to localised temperature rise sufficient to adversely affect the strength of the ropes. To promote dissipation of the heat, and prevent this happening, the tapered member 10 is preferably made of a material having a high heat conductivity, such as steel while the block member 20 is preferably made of a durable material selected for its low heat conductivity, such as hard wood, glass or ceramic.

A temperature indicating device, to monitor the rise in temperature due to use, may be included in the apparatus. A particularly useful arrangement is to incorporate a capsule 36, containing a salt which changes colour due to a rise in temperature, in the end of the block member 20 facing the open end of the tapered member 10. The capsule 36 has a transparent cover and the change in colour due to the temperature rise can be observed by the user when supine because of the position of the capule 36 in the block member. Alternatively a thermometer may be attached to the tapered member 10 as illustrated in FIG. 1.

To operate the apparatus, the user slips the loop 17 over the fixed object such as a door knob and then adopts a supine position face upward but directed away from the fixed object. The user then takes a hand grip 26 in each hand and places a foot in an individual band 34. Exercise is then achieved against selected resistance by alternate movement of the hands and feet. The ropes **24*a* and 24*b* move frictionally between the tapered member 10 and the block member 20 but the resistance can be adjusted to increase or decrease the effort needed by the user by rotating the ring 16. The user can also judge the extent of effort by the change in colour exhibited by the heat sensitive salt in the capsule 36**.

The advantage of the apparatus is that the effort of the user may be carefully graded and monitored with the result that the amount of effort used is entirely within the discretion of the user. The travel of the legs is adjusted by varying the position of the tube 28 on the ropes **24*a* and 24*b***.

I claim:

1. A portable exercising apparatus comprising an open ended inwardly tapered member, a block member positionally locatable inside said tapered member, said block member having a channel providing a passage for a pair of ropes frictionally engageable between said block member and said tapered member, means secured to said block member, and extending outward of the base of said tapered member, rotatable to adjust the position of said block member in said tapered member to vary the frictional resistance against movement on said pair of ropes therebetween, means to maintain said block member in the selected position, said rotatable means being adapted for detachable securement to a fixed object with the end of said pair of ropes emerging from one end of said channel and the said tapered member, each having an individual hand grip for the user, with the other ends of said pair of ropes emerging from the other end of said channel and then said tapered member each having individual means to contain a foot of the user.

2. A portable exercising apparatus according to claim 1 wherein said tapered member is constructed of a material having a relatively high heat conductivity and said block member is constructed of a material having a relatively low heat conductivity.

3. A portable exercising apparatus according to claim 2, wherein said tapered member is constructed of a metal, more particularly steel.

4. A portable exercising apparatus according to claim 2, wherein the material of said block member is selected from the group comprising hardwood, glass and ceramic.

5. A portable exercising apparatus according to claim 1, having a tube, spaced apart first and second pair of apertures to said tube, said first pair being diametrically opposed to said second pair, said other ends of said pair of ropes slidably entering said tube, each to an individual of said first pair of apertures, then crossing over to emerge from said pair of apertures in individual manner after which they are joined to form an endless first and second loop, said second loop being supported slidably in said pair of apertures, the arrangement being such that movement of said tube along said ropes will change and equalise the length of said first and second loops.

6. A portable exercising apparatus according to claim 5, wherein said loops are held together by a sleeve slidable thereon, said sleeve carrying a pair of bands which provide for said foot containment.

7. A portable exercising apparatus according to claim 1, having a temperature indicator showing the heat developed by the energy expended through exercise.

8. A portable exercising apparatus according to claim 7, wherein said temperature indicator is a transparent capsule containing a material which changes colour with rise in temperature.

9. A portable exercising apparatus according to claim 1, wherein said rotatable means comprises a threaded member secured to said block member and said means to maintain said selected position a locking nut on said threaded member bearing against the exterior of said base of said tapered member.

10. A portable exercising apparatus according to claim 9, wherein said threaded member terminates in a ring which carries a loop to provide for said detachable securement of the apparatus to a fixed object.

* * * * *